US008796566B2

(12) United States Patent
Kerner et al.

(10) Patent No.: US 8,796,566 B2
(45) Date of Patent: Aug. 5, 2014

(54) ROTARY PUSHBUTTON AND TOUCHPAD DEVICE AND SYSTEM AND METHOD FOR DETECTING ROTARY MOVEMENT, AXIAL DISPLACEMENT AND TOUCHPAD GESTURES

(75) Inventors: Robert E. Kerner, Chicago, IL (US); Torsten F. Chase, Glen Ellyn, IL (US); Kevin M. Dooley, Chicago, IL (US)

(73) Assignee: Grayhill, Inc., La Grange, IL (US)

( * ) Notice: Subject to any disclaimer, the term of this patent is extended or adjusted under 35 U.S.C. 154(b) by 269 days.

(21) Appl. No.: 13/406,617

(22) Filed: Feb. 28, 2012

(65) Prior Publication Data

US 2013/0220779 A1 Aug. 29, 2013

(51) Int. Cl.
*H01H 9/00* (2006.01)

(52) U.S. Cl.
USPC ..... 200/4

(58) Field of Classification Search
CPC ..... H01H 3/08; H01H 3/12; H01H 19/00; H01H 21/00; H01H 2003/08; H01H 2215/044; H01H 2231/016; H01H 2233/07; H01H 2239/074; H01H 2003/0293
USPC .... 200/11 R, 5 E, 13, 14, 11 C, 19.07, 19.08, 200/19.18, 296, 336
See application file for complete search history.

(56) References Cited

U.S. PATENT DOCUMENTS 4,880,950 A * 11/1989 Carson et al. ..... 200/547
6,323,846 B1 11/2001 Westerman et al.
6,555,770 B2 4/2003 Kawase
6,621,016 B2 9/2003 Ohba et al.
6,636,197 B1 10/2003 Goldenberg et al.
6,759,933 B2 7/2004 Fallak
6,828,957 B2 12/2004 Onodera
6,867,379 B2 3/2005 Hayashi
6,930,672 B1 8/2005 Kuribayashi
7,030,861 B1 4/2006 Westerman et al.
7,082,669 B2 8/2006 Imamura
7,109,469 B2 9/2006 Hayashi
7,193,166 B2 3/2007 Sakurai
7,327,348 B2 2/2008 Goldenberg et al.
7,342,186 B2 3/2008 Montalvo et al.
7,345,273 B2 3/2008 Ruttiger et al.
7,348,503 B2 3/2008 Shiroyama et al.
7,355,165 B2 4/2008 Shaw et al.
7,361,854 B2 4/2008 Basche et al.
7,423,886 B2 9/2008 Nishimoto et al.
7,439,458 B2 10/2008 Montalvo
7,441,202 B2 10/2008 Shen et al.

(Continued)

*Primary Examiner* — Edwin A. Leon
*Assistant Examiner* — Anthony R. Jimenez
(74) *Attorney, Agent, or Firm* — Patents + TMS, P.C.

(57) ABSTRACT

A rotary pushbutton and touchpad device, a system and a method detect rotary movement, axial displacement and touchpad gestures. The device has a knob which may rotate about an axis of rotation, may move upward and downward on the axis of rotation, and may have a touchpad. The touchpad may be fixedly connected to a rotary girder and/or a shaft clip within the knob which may prevent the touchpad from rotating when the knob is rotated. A substantially hollow and cylindrical outer shaft may be fixedly connected to the knob so that rotation of the knob rotates the outer shaft. The shaft clip may be fixedly connected to an actuator shaft which extends through the interior of the outer shaft and conveys axial displacement of the knob. Shutters extending from the outer shaft may rotate into or away from a position between a light emitter and a light pipe.

21 Claims, 5 Drawing Sheets

(56) References Cited

U.S. PATENT DOCUMENTS

| | | | | |
|---|---|---|---|---|
| 7,450,108 | B2 | 11/2008 | Clabunde et al. | |
| 7,519,223 | B2 | 4/2009 | Dehlin et al. | |
| 7,550,685 | B2 | 6/2009 | Tsuduki | |
| 7,579,559 | B2 | 8/2009 | Schelbert et al. | |
| 7,663,607 | B2 | 2/2010 | Hotelling et al. | |
| 7,745,749 | B2 | 6/2010 | Ito | |
| 7,907,125 | B2 | 3/2011 | Weiss et al. | |
| 7,915,549 | B2 | 3/2011 | Okidate | |
| 7,924,271 | B2 | 4/2011 | Christie et al. | |
| 7,936,341 | B2 | 5/2011 | Weiss | |
| 7,983,723 | B2 | 7/2011 | Dunko | |
| 8,130,214 | B2 * | 3/2012 | Aimi et al. | 345/184 |
| 2002/0015024 | A1 | 2/2002 | Westerman et al. | |
| 2004/0132498 | A1 * | 7/2004 | Clabunde et al. | 455/566 |
| 2004/0263489 | A1 | 12/2004 | Wallenius | |
| 2005/0162402 | A1 | 7/2005 | Watanachote | |
| 2006/0012584 | A1 | 1/2006 | Vassallo et al. | |
| 2007/0268274 | A1 | 11/2007 | Westerman et al. | |
| 2007/0268275 | A1 | 11/2007 | Westerman et al. | |
| 2008/0042987 | A1 | 2/2008 | Westerman et al. | |
| 2008/0042989 | A1 | 2/2008 | Westerman et al. | |
| 2008/0150906 | A1 | 6/2008 | Grivna | |
| 2008/0180404 | A1 | 7/2008 | Han et al. | |
| 2008/0180405 | A1 | 7/2008 | Han et al. | |
| 2008/0180406 | A1 | 7/2008 | Han et al. | |
| 2009/0066670 | A1 | 3/2009 | Hotelling et al. | |
| 2009/0115748 | A1 | 5/2009 | Tanaka et al. | |
| 2009/0199130 | A1 | 8/2009 | Tsern et al. | |
| 2009/0225038 | A1 | 9/2009 | Bolsinga et al. | |
| 2009/0244031 | A1 | 10/2009 | Westerman et al. | |
| 2009/0244032 | A1 | 10/2009 | Westerman et al. | |
| 2009/0249236 | A1 | 10/2009 | Westerman et al. | |
| 2009/0251438 | A1 | 10/2009 | Westerman et al. | |
| 2009/0284495 | A1 | 11/2009 | Geaghan et al. | |
| 2009/0315841 | A1 | 12/2009 | Cheng et al. | |
| 2010/0110031 | A1 | 5/2010 | Miyazawa | |
| 2010/0133073 | A1 | 6/2010 | Su | |
| 2010/0149109 | A1 | 6/2010 | Elias | |
| 2010/0177053 | A2 | 7/2010 | Yasutake | |
| 2010/0201634 | A1 | 8/2010 | Coddington | |
| 2010/0201639 | A1 | 8/2010 | Huang et al. | |
| 2010/0207892 | A1 | 8/2010 | Ling et al. | |
| 2010/0270133 | A1 | 10/2010 | Baker | |
| 2010/0283750 | A1 | 11/2010 | Kang | |
| 2010/0302211 | A1 | 12/2010 | Huang | |
| 2010/0315349 | A1 | 12/2010 | Choi | |
| 2010/0328224 | A1 | 12/2010 | Kerr et al. | |
| 2011/0007029 | A1 | 1/2011 | Ben-David | |
| 2011/0025652 | A1 | 2/2011 | Bonne | |
| 2011/0069029 | A1 | 3/2011 | Ryu | |
| 2011/0072345 | A1 | 3/2011 | Lim | |
| 2011/0074695 | A1 | 3/2011 | Rapp | |
| 2011/0102333 | A1 | 5/2011 | Westerman | |
| 2011/0109552 | A1 | 5/2011 | Yasutake | |
| 2011/0134079 | A1 | 6/2011 | Stark | |
| 2011/0148791 | A1 | 6/2011 | Luu | |
| 2011/0157041 | A1 | 6/2011 | Weiss et al. | |
| 2011/0164029 | A1 | 7/2011 | King et al. | |
| 2011/0169762 | A1 | 7/2011 | Weiss | |
| 2011/0216038 | A1 | 9/2011 | Stolov et al. | |
| 2011/0216041 | A1 | 9/2011 | Cho et al. | |
| 2011/0225524 | A1 | 9/2011 | Cifra | |
| 2011/0234503 | A1 | 9/2011 | Fitzmaurice et al. | |
| 2011/0242056 | A1 | 10/2011 | Lee et al. | |
| 2011/0248939 | A1 | 10/2011 | Woo et al. | |
| 2011/0252307 | A1 | 10/2011 | Williamson et al. | |
| 2012/0055763 | A1 * | 3/2012 | Chou | 200/4 |
| 2013/0032456 | A1 * | 2/2013 | Nakajima et al. | 200/336 |

* cited by examiner

ROTARY PUSHBUTTON AND TOUCHPAD DEVICE AND SYSTEM AND METHOD FOR DETECTING ROTARY MOVEMENT, AXIAL DISPLACEMENT AND TOUCHPAD GESTURES

BACKGROUND OF THE INVENTION

The present invention generally relates to a rotary pushbutton and touchpad device and a system and a method for detecting rotary movement, axial displacement and touchpad gestures. More specifically, the present invention relates to a device having a knob, and the knob may rotate about an axis of rotation, may move upward and downward on the axis of rotation, and may have a touchpad.

Various input devices exist for initiating functions or changing settings of electronic devices. For example, pushbuttons and rotary controls in an automobile may control a heater, an air conditioner, a fan speed, a navigation system, and/or an audio system in the automobile. A user pushes one of the pushbuttons to activate a first function of the electronic device associated with the pushbutton. Then the user pushes the pushbutton a subsequent time to activate a second function of the electronic device associated with the pushbutton. A user turns one of the rotary controls clockwise or counterclockwise, and the direction and the distance which the rotary control is rotated determines a setting for the electronic device associated with the rotary control.

A pushbutton control and a rotary control may be used in combination. For example, the user may push a pushbutton to obtain a first type of setting, such as bass level for an audio system, and then may use a rotary control to adjust the bass level. Then the user may push the pushbutton a subsequent time to obtain a second type of setting, such as treble level for the audio system, and then may adjust the treble level using the same rotary control used for adjusting the bass level.

Typically, the known input devices are arranged independently throughout the interior of the vehicle, such as, for example, on the dashboard control panel, the steering wheel, the central armrest, and one or more of the door panels. Therefore, the known input devices have the disadvantage that they consume a large amount of space. In addition, use of known input devices requires a user to extend one or more of the hands of the user to a variety of locations within the vehicle.

A need, therefore, exists for a rotary pushbutton and touchpad device. Further, a need exists for a system for detecting rotary movement, axial displacement and touchpad gestures. Still further, a need exists for a method for detecting rotary movement, axial displacement and touchpad gestures.

SUMMARY OF THE INVENTION

The present invention generally relates to a rotary pushbutton and touchpad device and a system and a method for detecting rotary movement, axial displacement and touchpad gestures. More specifically, the present invention relates to a device having a knob, and the knob may rotate about an axis of rotation, may move upward and downward on the axis of rotation, and may have a touchpad. The touchpad may be fixedly connected to a rotary girder and/or a shaft clip within the knob which may prevent the touchpad from rotating when the knob is rotated.

To this end, in embodiments of the present invention, a device is provided. In these embodiments, the device has a knob package having a knob, a touchpad and a touchpad PC board wherein the touchpad PC board is located within the knob and further wherein the knob has an opening in which the touchpad PC board is located wherein the touchpad PC board generates a signal indicative of user gestures applied to the touchpad and further wherein rotation of the knob package does not rotate the touchpad and does not rotate the touchpad PC board.

Further, in these embodiments, the device has an encoder package having an encoder housing, an outer shaft, and an encoder PC board wherein the encoder PC board is located within the encoder housing and further wherein the outer shaft is located at least partially within the encoder housing wherein the outer shaft is rotatably connected to the encoder housing and fixedly connected to the knob and further wherein the encoder PC board is fixedly connected to the encoder housing wherein the encoder PC board generates a signal indicative of a rotary position of the knob; and Still further, in these embodiments, the device has an electronics package having a housing base, a base shaft, a base PC board and an actuator shaft wherein the base shaft extends from the housing base and further wherein the base PC board is located within the housing base under the base shaft wherein the actuator shaft is located at least partially within the base shaft wherein the base PC board generates a signal indicative of an axial position of the knob wherein the base shaft extends through the outer shaft into the interior of the knob package to connect the knob package, the electronics package and the encoder package to each other.

In some embodiments, the device has a shaft clip located within the knob wherein the touchpad PC board is fixedly connected to the shaft clip and further wherein the base shaft extends through the outer shaft to connect to the shaft clip to connect the knob package, the electronics package and the encoder package to each other.

In some embodiments, the device has a rotary girder to which the touchpad is fixedly connected wherein the rotary girder has a substantially disc-like shape and further wherein the rotary girder is located between the touchpad and the shaft clip.

In some embodiments, the device has a light pipe located within the encoder housing wherein the light pipe has a first end and a second end which are connected by a middle portion and further wherein the middle portion is located farther from the encoder PC board than the first end and the second end.

In some embodiments, the device has grooves within the base shaft wherein insertion of ridges on the actuator shaft into the grooves connect the actuator shaft to the base shaft.

In some embodiments, the device has springs having protrusions wherein the springs are fixedly connected to the encoder housing and further wherein the protrusions insert into teeth extending from the outer shaft.

In some embodiments, the device has an elastically deformable dome located within the housing base under the base shaft wherein the elastically deformable dome is located between the actuator shaft and the base PC board.

In other embodiments of the present invention, a system for detecting rotary movement, axial displacement and touchpad gestures is provided. The system has a knob top having an opening; a knob bottom fixedly connected to the knob top; and a touchpad located at least partially within the opening wherein a user manipulates the touchpad to perform the touchpad gestures.

Further, in these embodiments, the system has an encoder housing from which an outer shaft extends wherein the outer shaft has a top end, a bottom end, an interior and an exterior and further wherein the top end of the outer shaft is fixedly connected to the knob bottom; shutters located within the encoder housing wherein the shutters extend outward from the outer shaft into the exterior of the outer shaft at the bottom end of the outer shaft; and an encoder PC board located within the encoder housing on one side of the shutters wherein the encoder PC board detects an intensity of light.

Still further, in these embodiments, the system has a housing base from which a base shaft extends wherein the base shaft extends through the interior of the outer shaft to a position between the knob bottom and the knob top wherein the knob bottom slides on the base shaft in a direction toward the housing base and slides on the base shaft in a direction away from the housing base; and an actuator shaft which slides in the base shaft in a first direction toward the housing base and perpendicular to the housing base and slides in a second direction away from the housing base and perpendicular to the housing base.

Moreover, in these embodiments, the system has a base PC board located within the housing base wherein an elastically deformable dome is located on the base PC board and between the actuator shaft and the base PC board and further wherein the elastically deformable dome has a base and a center wherein the base of the elastically deformable dome is fixedly connected to the base PC board and further wherein the base PC board generates a signal indicative of the axial displacement of the knob in response to depression of the knob pushing the actuator shaft downward into the elastically deformable dome so that the center of the elastically deformable dome contacts the base PC board.

In some embodiments, the system has a light pipe located within the encoder housing and in the exterior of the outer shaft wherein the light pipe is fixedly connected to the encoder housing and further wherein the light pipe is located on an opposite side of the shutters relative to the encoder PC board.

In some embodiments, the system has a rotary girder to which the touchpad is fixedly connected; a shaft clip located between the touchpad and the knob bottom wherein the rotary girder is located between the touchpad and the shaft clip and further wherein the base shaft connects to the shaft clip on an opposite side of the shaft clip relative to the touchpad wherein the shaft clip slides on the base shaft in a direction toward the housing base and slides on the base shaft in a direction away from the housing base; and a touchpad PC board located within the knob wherein the touchpad PC board generates a signal indicative of the touchpad gestures and further wherein the touchpad PC board is fixedly connected to the shaft clip so that rotation of the knob does not rotate the touchpad PC board.

In some embodiments, the system has springs located between the rotary girder and the shaft clip wherein the springs are fixedly connected to the shaft clip and further wherein the springs maintain a position of the touchpad within the opening of the knob top.

In other embodiments of the present invention, a method for detecting rotary movement, axial displacement and touchpad gestures is provided. In these embodiments, the method has the steps of performing the rotary movement by a user rotating a knob wherein rotation of the knob rotates an outer shaft fixedly connected to the knob and further wherein shutters extending outward from the outer shaft are rotated by rotation of the knob; emitting light from at least one encoder PC board; using an intensity of the light which travels past the shutters to generate a signal indicative of the rotary movement of the knob wherein the at least one encoder PC board uses the intensity of the light which travels past the shutters to generate the signal indicative of the rotary movement of the knob.

In these embodiments, the method has the steps of performing axial displacement of the knob by pushing the knob downward wherein the user pushing the knob downward moves an actuator shaft fixedly connected to the knob downward; and generating a signal indicative of the axial displacement of the knob wherein the base PC board generates the signal indicative of the axial displacement of the knob in response to downward movement of the actuator shaft moving a portion of the dome into contact with the base PC board.

In these embodiments, the method has the step of applying the touchpad gestures to a touchpad located at least partially within the knob wherein a touchpad PC board generates a signal indicative of the touchpad gestures in response to application of the touchpad gestures to the touchpad.

In some embodiments, the method has the step of transmitting the signal indicative of the rotary movement of the knob and the signal indicative of the axial displacement of the knob to the base PC board.

In some embodiments, the method has the step of preventing rotation of the actuator shaft when the knob rotates wherein ridges extending from the actuator shaft insert into grooves in a base shaft in which the actuator shaft is located and further wherein insertion of the ridges into the grooves prevents rotation of the actuator shaft when the knob rotates.

In some embodiments, the method has the step of preventing rotation of the touchpad PC board when the knob rotates wherein connection of the touchpad PC board to a shaft clip fixedly connected to the actuator shaft prevents rotation of the touchpad PC board when the knob rotates.

In some embodiments, the method has the step of preventing rotation of the touchpad when the knob rotates wherein connection of the touchpad to a rotary girder within the knob prevents rotation of the touchpad when the knob rotates.

In some embodiments, the method has the step of moving the knob upward after the knob is pushed downward wherein the knob is moved upward by the portion of the dome regaining a position not in contact with the base PC board to push the actuator shaft upward.

In some embodiments, the method has the step of inserting protrusions into teeth which extend from the outer shaft wherein insertion of the protrusions into the teeth as the knob rotates provides resistance against the rotary movement of the knob.

In some embodiments, the outer shaft is located at least partially within an encoder housing and further wherein the light pipe, the shutters and the encoder PC board are located within the encoder housing.

In some embodiments, the dome and the base PC board are located within a base housing and further wherein a base shaft extends from the base housing through the outer shaft to connect to a shaft clip located at least partially within the knob.

It is, therefore, an advantage of the present invention to provide a rotary pushbutton and touchpad device and a system and a method for detecting rotary movement, axial displacement and touchpad gestures.

Another advantage of the present invention is to provide a rotary pushbutton and touchpad device and a system and a method for detecting rotary movement, axial displacement and touchpad gestures which may reduce the number of input devices required in an automobile or other environment.

Further, an advantage of the present invention is to provide a rotary pushbutton and touchpad device and a system and a method for detecting rotary movement, axial displacement and touchpad gestures which may provide a multifunction input device.

Yet another advantage of the present invention is to provide a rotary pushbutton and touchpad device and a system and a method for detecting rotary movement, axial displacement and touchpad gestures which may enable a user to provide user input using only one hand.

Still further, an advantage of the present invention is to provide a rotary pushbutton and touchpad device and a system and a method for detecting rotary movement, axial displacement and touchpad gestures which may have a knob package, an encoder package and an electronics package connected to each other.

Moreover, another advantage of the present invention is to provide a rotary pushbutton and touchpad device and a system and a method for detecting rotary movement, axial displacement and touchpad gestures which may use a light pipe which directs light from a light emitter on a PC board to a light detector on the PC board.

Another advantage of the present invention is to provide a rotary pushbutton and touchpad device and a system and a method for detecting rotary movement, axial displacement and touchpad gestures which may house a touchpad within a rotary knob.

Further, an advantage of the present invention is to provide a rotary pushbutton and touchpad device and a system and a method for detecting rotary movement, axial displacement and touchpad gestures which may generate one or more signals indicating the rotary movement, the axial displacement and/or the touchpad gestures sensed by the device.

Yet another advantage of the present invention is to provide a rotary pushbutton and touchpad device and a system and a method for detecting rotary movement, axial displacement and touchpad gestures which may use deformation of a metal dome by an actuator shaft to detect the axial displacement.

Still further, an advantage of the present invention is to provide a rotary pushbutton and touchpad device and a system and a method for detecting rotary movement, axial displacement and touchpad gestures which may not rotate the touchpad when the rotary element of the device is rotated.

Moreover, an advantage of the present invention is to provide a rotary pushbutton and touchpad device and a system and a method for detecting rotary movement, axial displacement and touchpad gestures which may convey the axial displacement using an actuator shaft which does not rotate when the rotary element of the device is rotated.

Another advantage of the present invention is to provide a rotary pushbutton and touchpad device and a system and a method for detecting rotary movement, axial displacement and touchpad gestures which may sense the axial displacement using an actuator shaft which does not rotate and is located in the interior of a rotating outer shaft.

Further, an advantage of the present invention is to provide a rotary pushbutton and touchpad device and a system and a method for detecting rotary movement, axial displacement and touchpad gestures which may use shutters extending from a rotating outer shaft to detect the rotary movement.

Yet another advantage of the present invention is to provide a rotary pushbutton and touchpad device and a system and a method for detecting rotary movement, axial displacement and touchpad gestures which may detect one or more touches on the touchpad, one or more movements on the touchpad, an amount of time of the one or more movements on the touchpad, a speed of the one or more movements on the touchpad, and/or the like.

Additional features and advantages of the present invention are described in, and will be apparent from, the detailed description of the presently preferred embodiments and from the drawings.

DETAILED DESCRIPTION OF THE PREFERRED EMBODIMENTS

The present invention generally relates to a rotary pushbutton and touchpad device and a system and a method for detecting rotary movement, axial displacement and touchpad gestures. More specifically, the present invention relates to a device having a knob, and the knob may rotate about an axis of rotation, may move upward and downward on the axis of rotation, and may have a touchpad. The touchpad may be fixedly connected to a rotary girder and/or a shaft clip within the knob which may prevent the touchpad from rotating when the knob is rotated.

A substantially hollow and cylindrical outer shaft may be fixedly connected to the knob so that rotation of the knob rotates the outer shaft. The shaft clip may be fixedly connected to an actuator shaft which extends through the interior of the outer shaft and conveys axial displacement of the knob. Shutters extending from the outer shaft may rotate into a position between a light emitter and a light pipe and may rotate away from a position between the light emitter and the light pipe. Disruption of light transmission by the shutters may indicate an amount of rotation of the knob.

Figures 1, 2:
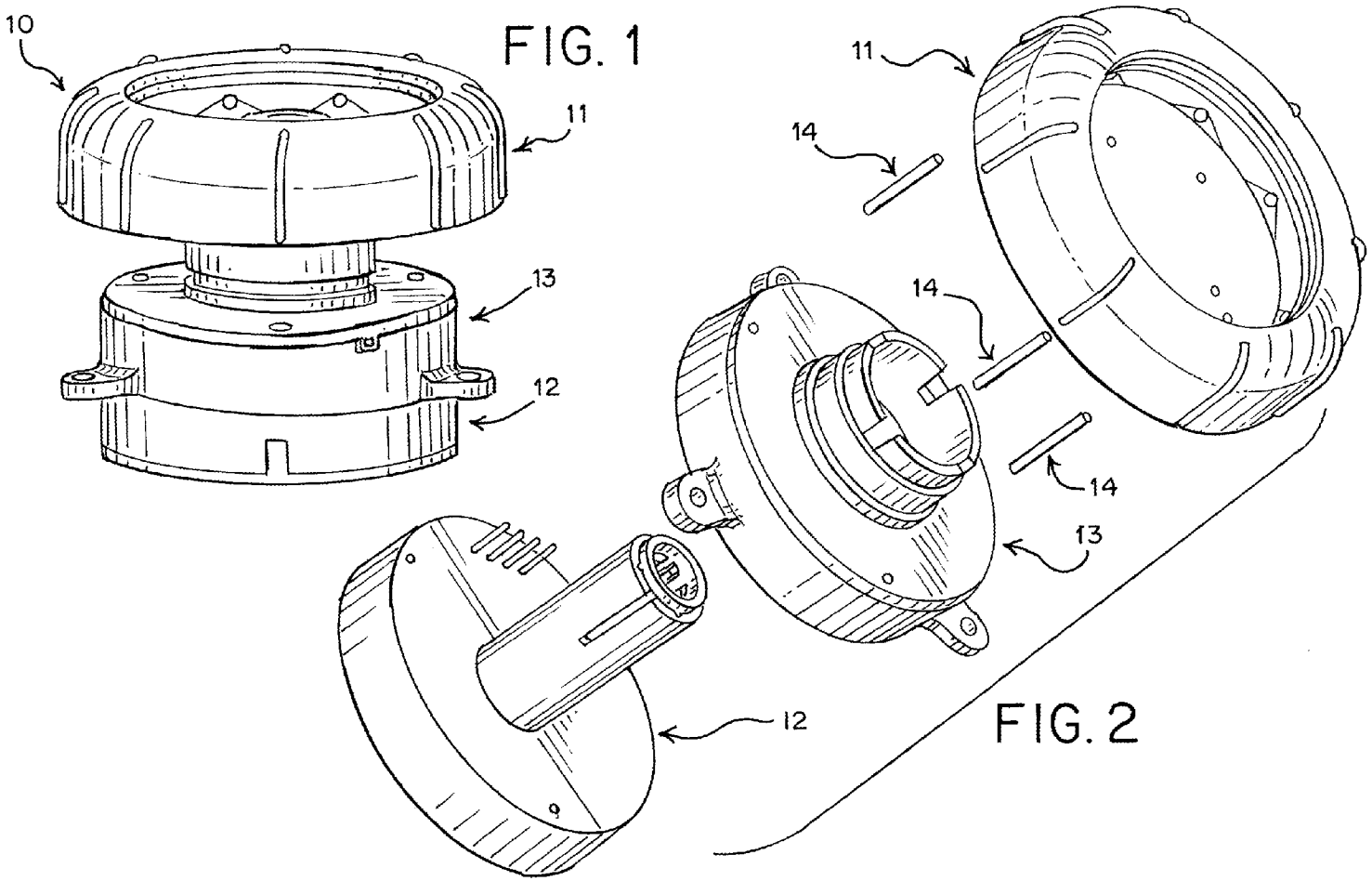
FIG. 1 illustrates a side perspective view of a rotary pushbutton and touchpad device in an embodiment of the present invention.
FIG. 2 illustrates an exploded perspective view of a rotary pushbutton and touchpad device in an embodiment of the present invention.

Referring now to the drawings wherein like numerals refer to like parts, FIGS. 1 and 2 generally illustrate an embodiment of a device 10 which may have a knob package 11. The knob package 11 may rotate about an axis of rotation and may move upward and downward on the axis of rotation. In an embodiment, the components of the knob package 11 discussed hereafter may form one integral part of the device 10. The device 10 may have an encoder package 13 and/or an electronics package 12. In an embodiment, the components of the encoder package 13 discussed hereafter may form one integral part of the device 10, and/or the components of the electronics package 12 discussed hereafter may form one integral part of the device 10. Rivets 14 may connect the encoder package 13 to the electronics package 12. FIG. 2 depicts three of the rivets 14; however, any number of the rivets 14 may connect the encoder package 13 to the electronics package 12.

Figure 3A:
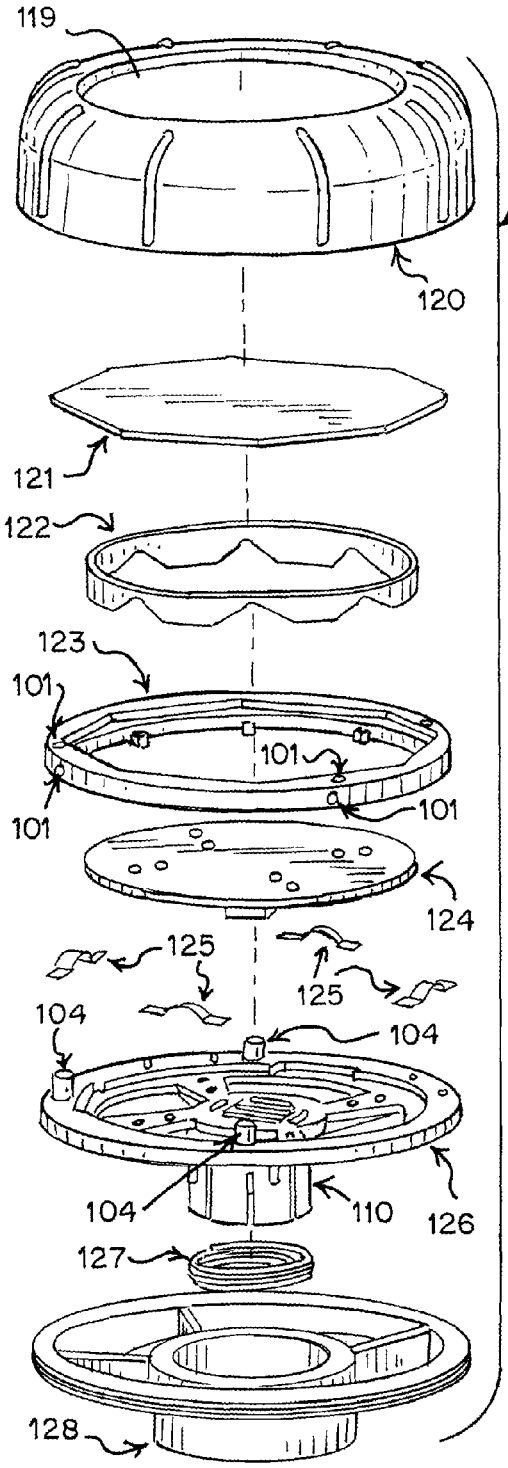
FIGS. 3A and 3B illustrate exploded perspective views of an electronics package of a rotary pushbutton and touchpad device in an embodiment of the present invention.
Figure 3B:
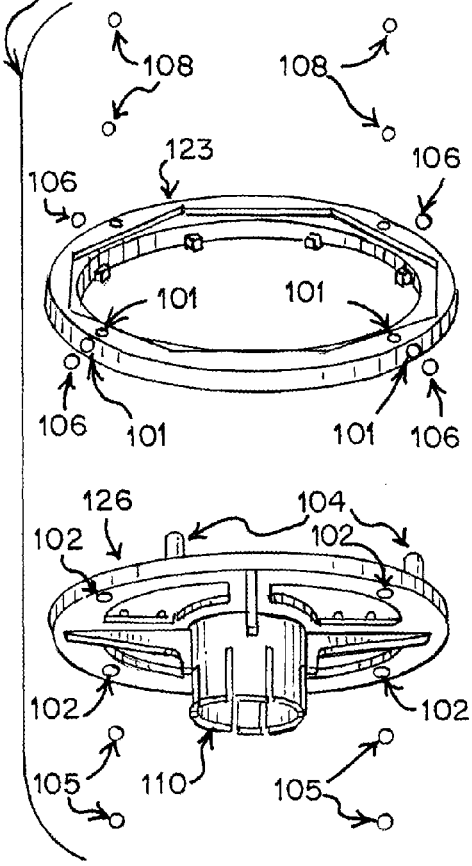

FIGS. 3A and 3B generally illustrate an embodiment of the knob package 11. The knob package 11 may have a knob top 120 fixedly connected to a knob bottom 128. The knob top 120 may have an opening 119 within which a touchpad 121 may be at least partially located. In an embodiment, the touchpad 121 may form the upper surface of the knob top 120. The touchpad 121 may be any shape; in an embodiment, the touchpad 121 may have an octagon shape.

The touchpad 121 may be protected by a lens, such as a glass lens and/or a plastic lens, and may be isolated from the lens by a small gap. The gap may enable the knob package 11, the knob top 120 and/or the lens to rotate without the touchpad 121 rotating. The lens may be opaque and/or transparent and may be made of any material. The present invention is not limited to a specific embodiment of the lens, and the lens may be any lens which at least partially covers the touchpad 121 while enabling use of the touchpad 121.

In an embodiment, the touchpad 121 may be a mutual projected capacitance touchpad. As known to one having ordinary skill in the art, a mutual projected capacitance touchpad has a protective cover located on a bonding layer. Under the bonding layer, a first layer has insulating material containing parallel driving lines, and a second layer has insulating material containing parallel sensing lines which are perpendicular to the driving lines. The first layer may be located above the second layer. A glass substrate is located under the first layer and the second layer, and a LCD display is located under the glass substrate. A capacitor is formed by one of the driving lines intersecting with one of the sensing lines. A voltage is applied to the driving lines, and positioning a finger or a conductive stylus on and/or proximate to the protective cover changes the local electric field to reduce the mutual capacitance at that location. The capacitance change at every individual point on the grid may be measured to determine the touch location by measuring the voltage in the sensing line.

Alternatively or additionally, the touchpad 121 may have and/or may be a digital resistive touchpad, an analog resistive touchpad, a resistive single touch touchpad, a resistive multi-touch touchpad, a surface capacitance touchpad, a self-projected capacitance touchpad and/or an IR touchpad. One or more of the sensing elements of the touchpad 121 may be constructed from materials which are opaque and/or transparent, such as a ridged printed circuit board and/or a flexible printed circuit board. The present invention is not limited to a specific embodiment of the touchpad 121.

A touchpad PC board 124 may be located between the knob top 120 and the knob bottom 128. The touchpad PC board 124 may be located under the touchpad 121 and/or proximate to the touchpad 121. The touchpad PC board 124 may generate signals in response to a user manipulating the touchpad 121. The touchpad 121 may detect one or more touches; in an embodiment, the touchpad 121 may detect five touches. The touchpad 121 may detect one or more touches on the touchpad, one or more movements on the touchpad, an amount of time of the one or more movements on the touchpad, a speed of the one or more movements on the touchpad, and/or the like. The signals generated by the touchpad PC board 124 may indicate the one or more touches on the touchpad, the one or more movements on the touchpad, the amount of time of the one or more movements on the touchpad, the speed of the one or more movements on the touchpad, and/or the like.

A rotary girder 123 may be located between the knob top 120 and the knob bottom 128. The rotary girder 123 may be any shape; in an embodiment, the rotary girder 123 may have a ring shape. The touchpad 121 may be fixedly connected to the rotary girder 123 using any means known to one having ordinary skill in the art; in an embodiment, the touchpad 121 may be fixedly connected to the rotary girder 123 using an adhesive. A light ring 122 may be located within and/or may be fixedly connected to the rotary girder 123, and the light ring 122 may be located between the touchpad PC board 124 and the touchpad 121.

A shaft clip 126 may be located between the rotary girder 123 and the knob bottom 128, and the shaft clip 126 may be located between the light ring 122 and the knob bottom 128. The shaft clip 126 may be located adjacent to the knob bottom 128. The shaft clip 126 may be any shape; in an embodiment, the shaft clip 126 may have disk shape. The shaft clip 126 may have an extension 110 protruding downward. The touchpad PC board 124 may be attached to an opposite side of the shaft clip 126 relative to the extension 110 using any means known to one having ordinary skill in the art; in an embodiment, the touchpad PC board 124 may be attached to the shaft clip 126 using an adhesive.

Knob package leaf springs 125 may contact the bottom surface of the rotary girder 123 and/or the top surface of the shaft clip 126. The knob package leaf springs 125 may be fixedly connected to the top surface of the shaft clip 126. FIG. 3A depicts four of the knob package leaf springs 125 contacting the bottom surface of the rotary girder 123 and/or the top surface of the shaft clip 126; however, any number of the knob package leaf springs 125 may contact the bottom surface of the rotary girder 123 and/or the top surface of the shaft clip 126. The knob package leaf springs 125 may provide tension between the rotary girder 123 and the shaft clip 126. For example, the knob package leaf springs 125 may force the rotary girder 123 toward the knob top 120 so that the rotary girder 123 maintains a position of the touchpad 121 within the opening 119 of the knob top 120. Knob package rods 104 may extend from the shaft clip 126 into the rotary girder 123 to prevent rotation of the rotary girder 123 relative to the shaft clip 126.

A retention spring 127 may be located between the knob bottom 128 and the shaft clip 126. The retention spring 127 may be connected to the shaft clip 126 and/or the extension 110 on the shaft clip 126. The retention spring 127 may maintain a position of shaft clip 126 within the knob package 11.

One or more top ball rollers 108 and/or one or more side ball rollers 106 may be located between the rotary girder 123 and the knob top 120. The rotary girder 123 may have cavities 101 in which the top ball rollers 108 and/or the side ball rollers 106 may be at least partially located. The top ball rollers 108 and/or the side ball rollers 106 may decrease the friction applied to the rotary girder 123 and/or the knob top 120 when the knob top 120 rotates relative to the rotary girder 123.

One or more bottom ball rollers 104 may be located between the shaft clip 126 and the knob bottom 128. The shaft clip 126 may have cavities 102 in which the bottom ball rollers 105 may be at least partially located. The bottom ball rollers 105 may decrease the friction applied to the rotary shaft clip 126 and/or the knob bottom 128 when the knob bottom 128 rotates relative to the shaft clip 126.

Figure 4:
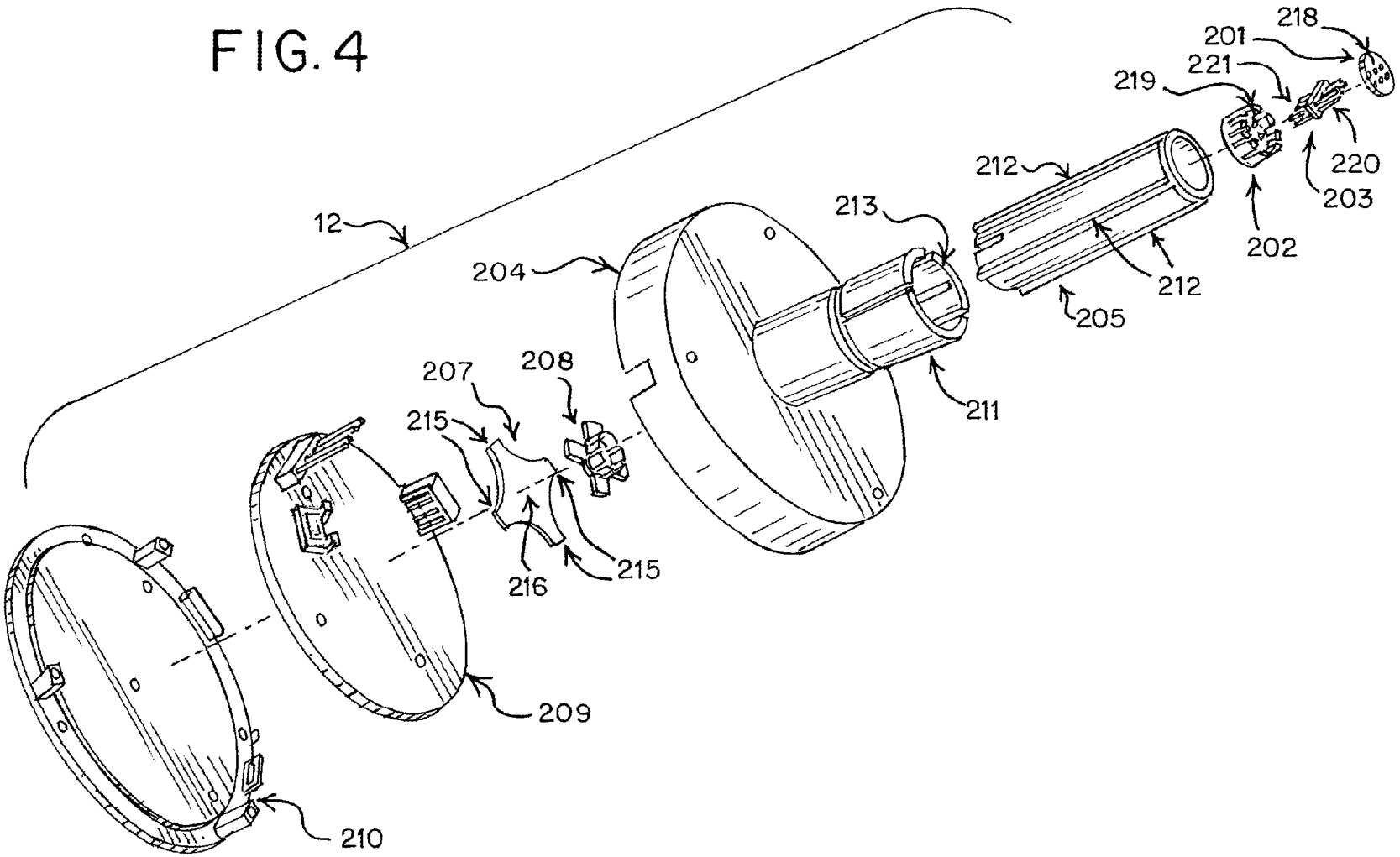
FIG. 4 illustrates an exploded perspective view of an encoder package of a rotary pushbutton and touchpad device in an embodiment of the present invention.

FIG. 4 generally illustrates an embodiment of the electronics package 12. The electronics package 12 may have a housing base 204 from which a base shaft 211 may extend. The base shaft 211 may be hollow and/or may be cylindrical. In an embodiment, the base shaft 211 may be integral with the housing base 204. The base shaft 211 may be connected to the shaft clip 126 and/or the extension 110 of the shaft clip 126. The actuator shaft 205 may insert into the extension 110 of the shaft clip 126 to connect the base shaft 211 to the shaft clip 126. The shaft clip 126 may slide down the exterior of the base shaft 211 in a direction toward the housing base 204 or slide up the exterior of the base shaft 211 in a direction away from the housing base 204.

An actuator shaft 205 may be located within the base shaft 211. The actuator shaft 205 may be cylindrical. The actuator shaft 205 may have ridges 212 which may insert into grooves 213 in the base shaft 211, and insertion of the ridges 212 into the grooves 213 may prevent rotation of the actuator shaft 205 relative to the housing base 204 and/or the base shaft 211. The actuator shaft 205 may slide within the base shaft 211 in a direction toward the housing base 204 or away from the housing base 204. The ridges 212 and/or the grooves 213 may be substantially perpendicular relative to the housing base 204.

A pushbutton actuator 208 may be connected to an opposite end of the actuator shaft 205 relative to the shaft clip 126. The pushbutton actuator 208 may contact the housing base 204 and/or the base shaft 211 to prevent the actuator shaft 205 from being pulled from the base shaft 211 as the actuator shaft 205 slides away from the housing base 204. A pushbutton dome 207 may be located under the actuator shaft 205 and/or the pushbutton actuator 208. In an embodiment, the pushbutton dome 207 may be located within a pocket (not shown) in the housing base 204.

The pushbutton dome 207 may be a dome-shaped piece of metal which may have a base 215 and/or a center 216. In an embodiment, the pushbutton dome 207 may made of rubber with impregnated carbon. The pushbutton dome 207 may be made of any material which enables elastic deformation of the pushbutton dome 207. For example, the pushbutton dome 207 may have a resting position in which the center 216 is located above the base 215. Force on the center 216 of the pushbutton dome 207 may push the center 216 into a position coplanar with the base 215. After the force is removed, the pushbutton dome 207 may regain the resting position by the center 216 returning to the resting position above the base 215.

The actuator shaft 205 may insert into the extension 110 of the shaft clip 126 to fixedly connect to the shaft clip 126. A header housing 202 may be connected to an opposite end of the actuator shaft 205 relative to the pushbutton actuator 208. An electrical connector 203, such as, for example, a six-pin header, may be located within the header housing 202. The actuator shaft 205 may position the electrical connector 203 within the extension 110 of the shaft clip 126 and/or proximate to the touchpad PC board 124.

A header cover 201 may connect to the header housing 202 to enclose the header 202 within the header housing 202. The header cover 201 may have apertures 218, the header 203 may have upper pins 220, and the upper pins 220 of the header 203 may extend upward through the apertures 218 of the header cover 201 to connect to the touchpad PC board 124. The header housing 202 may have apertures 219, the header 203 may have lower pins 221, and the lower pins 221 of the header 203 may extend downward through the apertures 219 of the header housing 202.

A base PC board 209 may be located within the housing base 204. The base PC board 209 may have any shape; in an embodiment, the base PC board 209 may have a substantially circular shape. The pushbutton dome 207 may be located between the actuator shaft 205 and the base PC board 209 and/or may be located between the pushbutton actuator 208 and the base PC board 209. The base 215 of the pushbutton dome 207 may be fixedly connected to the base PC board 209.

A base cover 210 may fixedly connect to the housing base 204 to enclose the base PC board 209 and/or the pushbutton dome 207 within the electronics package 12. The rivets 14 may extend through the housing base 204 to connect to the base cover 210. The base cover 210 may have any shape; in an embodiment, the base PC cover 210 may have a substantially circular shape which may substantially the same as the shape of the base PC board 209. The base PC board 209 may receive and may process signals from an encoder PC board 313 in the encoder package 13 discussed in more detail hereafter. The base PC board 209 may receive and may process signals from the touchpad PC board 124.

Figure 6:
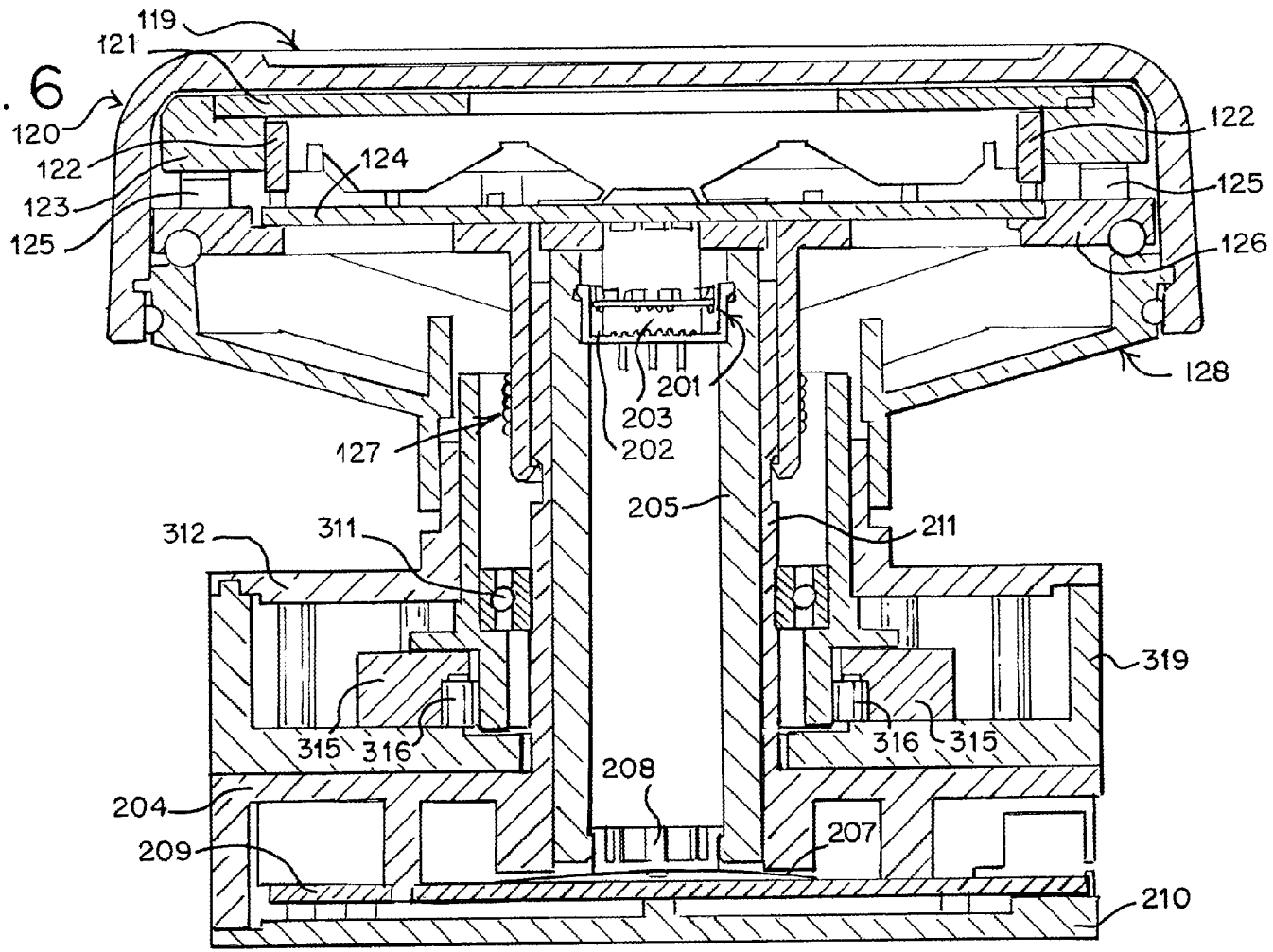
FIG. 6 illustrates a side cross-sectional view of a rotary pushbutton and touchpad device in an embodiment of the present invention.

Referring to FIG. 6, the base PC board 209 may detect axial displacement of the knob package 11. For example, the center 216 of the pushbutton dome 207 may be located above the base PC board 209 when the knob package 11 is not axially displaced.

Axial displacement of the knob package 11 may be performed by the user pushing the knob package 11 downward relative to the housing base 204. As a result, the rotary girder 123 within the knob package 11 may move downward to push the shaft clip 126 downward. Moving the shaft clip 126 downward may move the actuator shaft 205 downward within the base shaft 211. Moving the actuator shaft 205 downward may cause the pushbutton actuator 208 attached to the actuator shaft 205 to push the center 216 of the pushbutton dome 207 downward toward the base PC board 209. As the pushbutton dome 207 is elastically deformed, the center 216 of the pushbutton dome 207 may become level with the base 215 of the pushbutton dome 207. Positioning the center 216 of the pushbutton dome 207 level with the base 215 of the pushbutton dome 207 may contact the center 216 of the pushbutton dome 207 to the base PC board 209 to close a pushbutton circuit in the base PC board 209. The closed pushbutton circuit of the base PC board 209 may provide a signal which indicates that the knob package 11 is in the depressed position.

When the user releases downward force on the knob package 11, the center 216 of the pushbutton dome 207 may move upward for the pushbutton dome 207 to regain the resting position. As a result, the pushbutton dome 207 may force the actuator shaft 205 upward to return the knob package 11 to a non-axially displaced position. In an embodiment, a spring may be used to force the actuator shaft 205 upward to return the knob package 11 to a non-axially displaced position.

As a result of the actuator shaft 205 moving upward, the center 216 of the pushbutton dome 207 may be removed from contact with the base PC board 209. Removing the center 216 of the pushbutton dome 207 from contact with the base PC board 209 may open the pushbutton circuit. As a result, the open pushbutton circuit of the base PC board 209 may cease to provide the signal indicating that the knob package 11 is axially displaced.

Alternatively or additionally, the base PC board 209 may use magnetic field detection sensing to detect axial displacement of the knob package 11. For example, the base PC board 209 may use Hall effect sensing to detect axial displacement of the knob package 11. Alternatively or additionally, the base PC board 209 may use inductive sensors to detect axial displacement of the knob package 11. Alternatively or additionally, the base PC board 209 may use optics to detect axial displacement of the knob package 11. For example, axial displacement of the knob package 11 may modify an amount of light reaching a light detector. The amount of light detected may indicate an axial position of the knob package 11 and/or an amount of axial displacement of the knob package 11, and the base PC board 209 may detect the amount of light.

Figure 5:
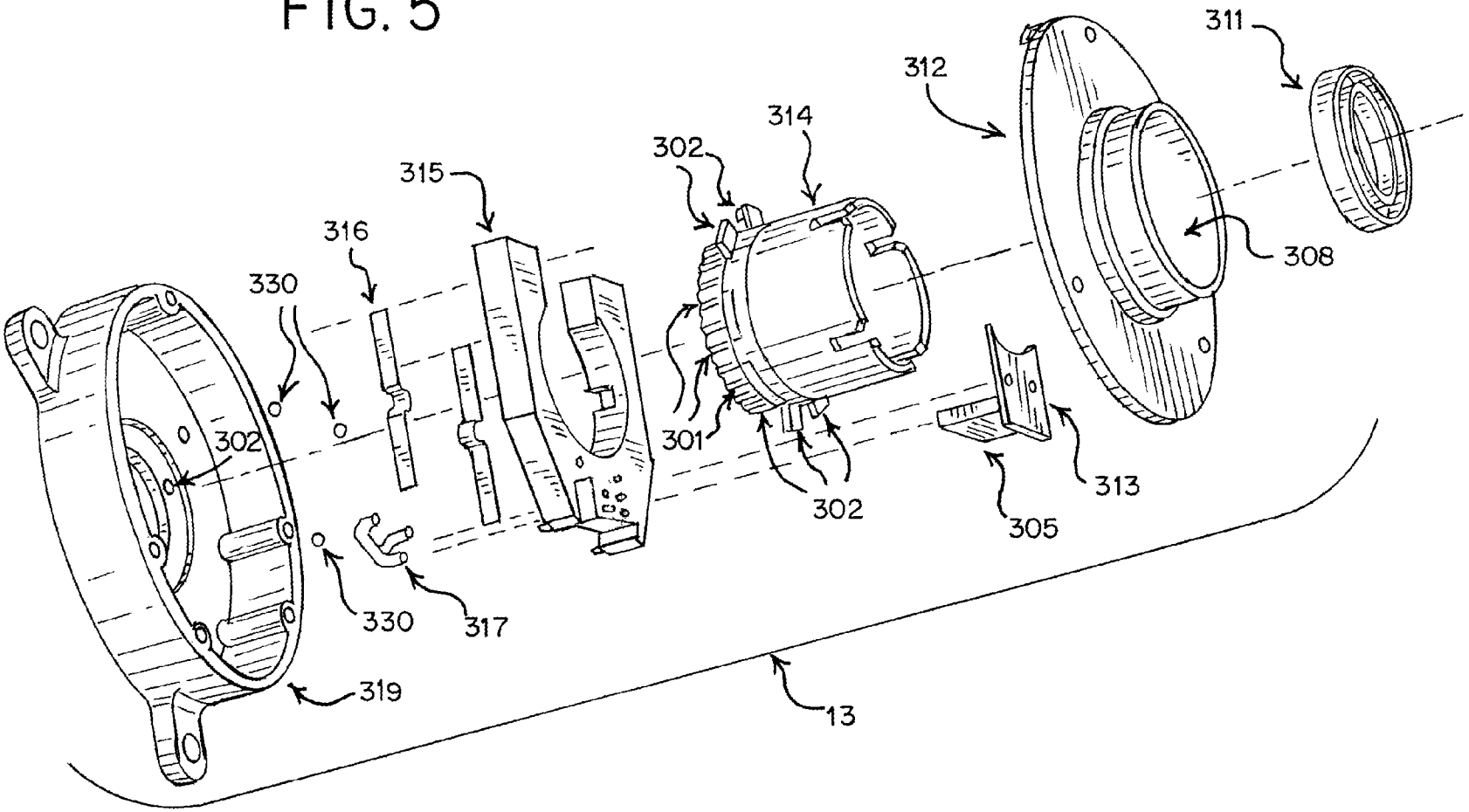
FIG. 5 illustrates an exploded perspective view of an knob package of a rotary pushbutton and touchpad device in an embodiment of the present invention.

FIG. 5 generally illustrates an embodiment of the encoder package 13. The encoder package 13 may have an encoder package housing 319, and a detent/code housing 315 may be fixedly connected to the encoder package housing 319. The detent/code housing 315 may be located within the encoder package housing 319. An outer shaft 314 may be rotatably connected to the detent/code housing 315, and one or more encoder ball rollers 330 may be located between the encoder package housing 319 and the outer shaft 314. The encoder package housing 319 may have cavities 302 in which the encoder ball rollers 330 may be at least partially located. The encoder ball rollers 330 may decrease friction applied to the outer shaft 314 and/or the encoder package housing 319 when the outer shaft 314 rotates relative to the encoder package housing 319.

The outer shaft 314 may be hollow and/or may be cylindrical. A ball bearing 311 may be located within the outer shaft 314. The ball bearing 311 may be any shape; in an embodiment, the ball bearing 311 may have a ring shape. The outer shaft 314 may have teeth 301 extending outward from the outer circumference of the bottom end of the outer shaft 314. The outer shaft 314 may be fixedly connected to the knob bottom 128 so that rotation of the knob package 11 rotates the outer shaft 314. The outer shaft 314 may have shutters 302 protruding from positions adjacent to and/or above the rounded teeth 301. The shutters 302 may be evenly distributed along the outer circumference of the outer shaft 314.

One or more detent springs 316 having rounded protrusions 320 may be fixedly connected to the detent/code housing 315. FIG. 5 depicts two of the detent springs 316; however, any number of the detent springs 316 may be used. Rotation of the outer shaft 314 may cause the rounded protrusions 320 of the detent springs 316 to insert between the teeth 301 of the outer shaft 314. As previously set forth, the outer shaft 314 may be fixedly connected to the knob bottom 128; therefore, insertion of the rounded protrusions 320 between the teeth 301 of the outer shaft 314 may establish discrete rotational positions of the knob package 11, may provide resistance against rotation of the knob package 11, and/or may provide audible feedback and/or tactile feedback to the user rotating the knob package 11.

The one or more detent springs 316 may have the lowest potential energy when the one or more detent springs 316 are inserted between the teeth 301 of the outer shaft 314. For example, the lowest potential energy may be when the knob package 11 is aligned with one of the discrete rotational positions of the knob package 11. If the knob package 11 is rotated out of one of the discrete rotational positions, the one or more detent springs 316 may be stretched into a higher potential energy state. The one or more detent springs 316 in the higher potential energy state may exert a force urging the knob package 11 into one of the discrete rotational positions, such as the previous discrete position and/or one of the adjacent discrete rotational positions.

Alternatively or additionally, a coil spring may be utilized to establish the discrete rotational positions of the knob package 11. For example, the coil spring may be mounted on the housing base 204, in the detent/code housing 315, and/or to the outer shaft 314. An object, such as a stainless steel ball, may travel through a cam-type pathway and may act upon the coil spring. The coil spring may move between a higher energy state and a lower energy state according to the position of the outer shaft 314 and may thereby exert a force urging the knob package 11 into one of the discrete rotational positions.

Alternatively or additionally, one or more pole magnets and/or one or more magnetic conducting pathways may be attached to the housing base 204, the detent/code housing 315, and/or the outer shaft 314. The one or more pole magnets may be mounted so that the one or more magnetic conducting pathways are substantially aligned when the knob package 11 is positioned in one of the discrete rotational positions.

A light pipe 317 and/or the encoder PC board 313 may be fixedly connected to the detent/code housing 315. For example, the encoder PC board 313 may be connected to a support 305 which may be connected to the detent/code housing 315. In an embodiment, the support 305 may be perpendicular to the encoder PC board 313.

An encoder bushing 312 may fixedly connect to the encoder package housing 319 to enclose the teeth 301, the shutters 302, the detent springs 316, the light pipe 317 and/or the encoder PC board 313 within the encoder package 13. The encoder bushing 312 may have an encoder bushing opening 308 through which the outer shaft 314 may extend to connect to the knob bottom 128.

The encoder PC board 313 may have one or more light emitters and/or one or more light detectors (not shown). One end of the light pipe 317 may receive light from the encoder PC board 313, and the light pipe 317 may reflect the light out of the opposite end of the light pipe 317 to the light detector on the encoder PC board 313. For example, the light pipe 317 may receive light from the encoder PC board 313 in one end, the light may exit the light pipe 317 from an opposite end, and a middle portion of the light pipe 317 located between the two ends may be located farther from the encoder PC board than the two ends. The two ends of the light pipe 317 may be coplanar. Embodiments of the light pipe 317 and the encoder PC board 313 are disclosed in U.S. Pat. No. 7,355,165 to Shaw et al. assigned to the assignee of the present application, and U.S. Pat. No. 7,355,165 is incorporated by reference in its entirety.

Rotation of the outer shaft 314 may rotate the shutters 302. Rotation of the outer shaft 314 may rotate one of the shutters 302 into a position between the one or more light emitters of the encoder PC board 313 and the light pipe 317. Positioning one of the shutters 302 between the one or more light emitters of the encoder PC board 313 and the light pipe 317 may prevent the light pipe 317 from receiving light emitted by the encoder PC board 313. For example, one of the shutters 302 may absorb light emitted from the encoder PC board 313, may block light emitted from the encoder PC board 313 from entering the light pipe 317, and/or may deflect light away from the light pipe 317. As a result, the one of the shutters 302 positioned between the one or more light emitters of the encoder PC board 313 and the light pipe 317 may prevent the light pipe 317 from directing light to the one or more light detectors on the encoder PC board 313.

Additional rotation of the outer shaft 314 may rotate the one of the shutters 302 away from the position between the one or more light emitters of the encoder PC board 313 and the light pipe 317. As a result, the light pipe 317 may receive light emitted by the encoder PC board 313 and/or may direct the light to the one or more light detectors on the encoder PC board 313.

Rotation of the knob package 11 may rotate the knob bottom 128. As a result, the outer shaft 314 fixedly connected to the knob bottom 128 may rotate. Rotation of the outer shaft 128 may cause one or more of the shutters 302 of the outer shaft 314 to disrupt the transmission of light to the light pipe 317 as previously set forth. The disruption of the light transmission to the one or more light detectors on the encoder PC board 313 may enable the encoder PC board 313 to detect rotation of the knob package 11. The encoder PC board 313 may output a signal based on an amount, a direction and/or an intensity of the light. The signal may correspond to and/or may indicate a location, a position and/or an amount of rotation of the knob package 11. The encoded location, the encoded position and/ore the encoded rotation may be absolute and/or relative.

In an embodiment, the encoder package 13 may have an additional encoder PC board (not shown). In such an embodiment, the encoder PC board 313 may have the light emitter, and/the additional encoder PC board may have the light detector; alternatively, the encoder PC board 313 may have the light detector, and/the additional encoder PC board may have the light emitter.

In such an embodiment, rotation of the outer shaft 314 may rotate one of the shutters 302 into a position between the light emitter of one of the encoder PC boards and the light detector of the other encoder PC board. Positioning one of the shutters 302 between the light emitter and the light detector may prevent the light detector from receiving light emitted by the light emitter. For example, one of the shutters 302 may absorb light emitted from the light emitter, may block light emitted from the light emitter from traveling to the light detector, and/or may deflect light away from the light detector. As a result, the one of the shutters 302 positioned between the light emitter and the light detector may prevent light emitted by one of the encoder PC boards from traveling to the other encoder PC board.

In such an embodiment, additional rotation of the outer shaft 314 may rotate the one of the shutters 302 away from the position between the light emitter and the detector. As a result, the light detector on one of the encoder PC boards may receive light emitted by the light emitter on the other encoder PC board.

In an embodiment, the light may be infrared light. Alternatively or additionally, the light may include other wavelengths of light. The present invention is not limited to a specific wavelength of light emitted and detected by the encoder PC board 313 and/or the additional encoder PC board, and the encoder PC board 313 and/or the additional encoder PC board may emit and detect any wavelength of light. Alternatively or additionally, the location, the position and/or the amount of rotation of the knob package 11 may be detected using magnetic Hall effect sensing. For example, the location, the position and/or the amount of rotation of the knob package 11 may be detected using a voltage difference across an electrical conductor.

Rotation of the knob package 11 may rotate the knob bottom 128. As a result, the outer shaft 314 fixedly connected to the knob bottom 128 may rotate. Rotation of the outer shaft 128 may cause one or more of the shutters 302 of the outer shaft 314 to disrupt the transmission of light from one of the encoder PC boards to the other encoder PC board as previously set forth. The disruption of the light transmission may enable one of the encoder PC boards to detect rotation of the knob package 11. One of the encoder PC boards may output a signal based on an amount, a direction and/or an intensity of the light. The signal may correspond to and/or may indicate a location, a position and/or an amount of rotation of the knob package 11.

FIG. 6 generally illustrates an embodiment of the device 10 formed by the knob package 11, the encoder package 13 and/or the electronics package 12. The base shaft 211 of the electronics package 12 may extend through the outer shaft 314 of the encoder package 13. As previously set forth, the base shaft 211 of the electronics package 12 may be connected to the shaft clip 126 of the knob package 11. As a result, the electronics package 12 may connect to the knob package 11. Connection of the electronics package 12 to the knob package 11 may position the encoder package 13 between the knob bottom 128 and the housing base 204 of the electronics package 12. Additionally or alternatively, the rivets 14 connecting the encoder package 13 to the electronics package 12 may position the encoder package 13 between the knob bottom 128 and the housing base 204 of the electronics package 12.

The bottom of the encoder package housing 319 may be at least partially in contact with and/or located on the top of the base housing 204. The top of the base housing 204 may be at least partially in contact with and/or located below the bottom of the encoder package housing 319. In an embodiment, the entirety of the bottom of the encoder package housing 319 may be in contact with and/or located on the entirety of the top of the base housing 204.

The ball bearing 311 may be located between the base shaft 211 and the outer shaft 314. The ball bearing 311 may enable the outer shaft 314 to rotate relative to the base shaft 211 with minimal friction applied to the outer shaft 314 and the base shaft 211.

Backlight, highlight, proximity and/or touch functions may be provided by one or more components in a separate housing relative to the encoder package 13 and/or the electronics package 12. For example, the knob package 11 may contain the one or more components which provide the backlight, highlight, proximity and/or touch functions. In such an embodiment, the encoder package 13, the electronics package 12 and the knob package 11 may be formed by three distinct housings. In some embodiments, the device 10 may be mounted in a panel, such as a panel in a vehicle, so that the knob package 11 is positioned above the panel for access by a user and the encoder package 13 and/or the electronics package 12 are positioned below and/or within the panel.

Alternatively, the encoder package 13, the electronics package 12 and the knob package 11 may be formed by one distinct housing. Alternatively, two of the encoder package 13, the electronics package 12 and the knob package 11 may be formed by one distinct housing and the other package may be formed by another distinct housing.

As a result of the present invention, the device 10 may enable a user to provide pushbutton input by axially displacing the knob package 11 downward relative to the electronics package 12. Pushing the knob package 11 downward relative to the electronics package 12 may push the actuator shaft 205 downward relative to the pushbutton dome 207 to push the center 216 of the pushbutton dome 207 into contact with the base PC board 209. For example, the shaft clip 126 may push the actuator shaft 205 downward relative to the pushbutton dome 207 to push the center of the pushbutton dome 207 into contact with the base PC board 209. In response, the base PC board 209 may provide a signal which indicates that the knob package 11 is axially displaced.

In addition, the device 10 may enable a user to provide rotary input by rotating the knob package 11 relative to the electronics package 12. Rotating the knob package 11 may rotate the outer shaft 314 so that one or more of the shutters 302 of the outer shaft 314 may disrupt the transmission of light to the light pipe 317. The disruption of the light transmission by the light pipe 317 to the light detector on the encoder PC board 313 may enable the encoder PC board 313 to detect rotation of the knob package 11. The encoder PC board 313 may output a signal which may indicate a location, a position and/or an amount of rotation of the knob package 11. The encoder PC board 313 may convey the signal indicating the location, the position and/or the amount of rotation of the knob package 11 to the base PC board 209.

In addition, the device 10 may enable a user to provide touchpad input. The touchpad PC board 124 may be located under the touchpad 124. The touchpad PC board 124 may generate a signal in response to a user manipulating the touchpad 121 with touchpad gestures. The touchpad PC board 124 may convey the signal indicating the touchpad gestures to the base PC board 209.

Various changes and modifications to the presently preferred embodiments described herein will be apparent to those skilled in the art. Such changes and modifications may be made without departing from the spirit and scope of the present invention and without diminishing its attendant advantages. Therefore, such changes and modifications are intended to be covered by the appended claims.

We claim:

1. A device comprising:

a knob package having a knob, a touchpad, a sensor, and a touchpad PC board wherein the sensor is associated with the touchpad and further wherein the sensor detects a user gesture wherein the touchpad PC board is located within the knob and further wherein the knob has an opening in which the touchpad PC board is located wherein the touchpad PC board generates a signal indicative of the user gesture applied to the touchpad as measured by the sensor and further wherein rotation of the knob package does not rotate the touchpad and does not rotate the touchpad PC board;

an encoder package having an encoder housing, an outer shaft, and an encoder PC board wherein the encoder PC board is located within the encoder housing and further wherein the outer shaft is located at least partially within the encoder housing wherein the outer shaft is rotatably connected to the encoder housing and fixedly connected to the knob and further wherein the encoder PC board is fixedly connected to the encoder housing wherein the encoder PC board generates a signal indicative of a rotary position of the knob; and an electronics package having a housing base, a base shaft, a base PC board and an actuator shaft wherein the base shaft extends from the housing base and further wherein the base PC board is located within the housing base under the base shaft wherein the actuator shaft is located at least partially within the base shaft wherein the base PC board generates a signal indicative of an axial position of the knob wherein the base shaft extends through the outer shaft into the interior of the knob package to connect the knob package, the electronics package and the encoder package to each other.

2. The device of claim 1 further comprising:

a shaft clip located within the knob wherein the touchpad PC board is fixedly connected to the shaft clip and further wherein the base shaft extends through the outer shaft to connect to the shaft clip to connect the knob package, the electronics package and the encoder package to each other.

3. The device of claim 2 further comprising:

a rotary girder to which the touchpad is fixedly connected wherein the rotary girder has a substantially disc-like shape and further wherein the rotary girder is located between the touchpad and the shaft clip.

4. The device of claim 1 further comprising:

a light pipe located within the encoder housing wherein the light pipe has a first end and a second end which are connected by a middle portion and further wherein the middle portion is located farther from the encoder PC board than the first end and the second end.

5. The device of claim 1 further comprising:

grooves within the base shaft wherein insertion of ridges on the actuator shaft into the grooves connect the actuator shaft to the base shaft.

6. The device of claim 1 further comprising:

springs having protrusions wherein the springs are fixedly connected to the encoder housing and further wherein the protrusions insert into teeth extending from the outer shaft.

7. The device of claim 1 further comprising:

an elastically deformable dome located within the housing base under the base shaft wherein the elastically deformable dome is located between the actuator shaft and the base PC board.

8. A system for detecting rotary movement, axial displacement and touchpad gestures, the system comprising:

a knob having a knob top and a knob bottom wherein the knob top has an opening and further wherein the knob bottom is fixedly connected to the knob top;

a touchpad located within the opening wherein a user manipulates the touchpad to perform the touchpad gestures;

a touchpad PC board located within the knob wherein the touchpad PC board generates a signal indicative of the touchpad gestures applied to the touchpad;

an encoder housing from which an outer shaft extends wherein the outer shaft has a top end, a bottom end, an interior and an exterior and further wherein the top end of the outer shaft is fixedly connected to the knob bottom;

shutters located within the encoder housing wherein the shutters extend outward from the outer shaft into the exterior of the outer shaft at the bottom end of the outer shaft;

an encoder PC board located within the encoder housing on one side of the shutters wherein the encoder PC board detects an intensity of light;

a housing base from which a base shaft extends wherein the base shaft extends through the interior of the outer shaft to a position between the knob bottom and the knob top wherein the knob bottom slides on the base shaft in a direction toward the housing base in response to an applied downward force on the knob top and slides on the base shaft in a direction away from the housing base in response to a release of the applied downward force on the knob top;

an actuator shaft which slides in the base shaft in a first direction toward the housing base and perpendicular to the housing base in response to an applied downward force on the knob top and slides in a second direction away from the housing base and perpendicular to the housing base in response to a release of the applied downward force on the knob top; and a base PC board located within the housing base wherein an elastically deformable dome is located on the base PC board and between the actuator shaft and the base PC board and further wherein the elastically deformable dome has a base and a center wherein the base of the elastically deformable dome is fixedly connected to the base PC board and further wherein the base PC board generates a signal indicative of the axial displacement of the knob in response to depression of the knob pushing the actuator shaft downward into the elastically deformable dome so that the center of the elastically deformable dome contacts the base PC board.

9. The system of claim 8 further comprising:

a light pipe located within the encoder housing and in the exterior of the outer shaft wherein the light pipe is fixedly connected to the encoder housing and further wherein the light pipe is located on an opposite side of the shutters relative to the encoder PC board.

10. The system of claim 9 further comprising:

a rotary girder to which the touchpad is fixedly connected;

a shaft clip located between the touchpad and the knob bottom wherein the rotary girder is located between the touchpad and the shaft clip and further wherein the base shaft connects to the shaft clip on an opposite side of the shaft clip relative to the touchpad wherein the shaft clip slides on the base shaft in a direction toward the housing base in response to an applied downward force on the knob top and slides on the base shaft in a direction away from the housing base in response to a release of the applied downward force on the knob top; and a touchpad PC board located within the knob wherein the touchpad PC board generates a signal indicative of the touchpad gestures and further wherein the touchpad PC board is fixedly connected to the shaft clip so that rotation of the knob does not rotate the touchpad PC board.

11. The system of claim 10 further comprising:

springs located between the rotary girder and the shaft clip wherein the springs are fixedly connected to the shaft clip and further wherein the springs maintain a position of the touchpad within the opening of the knob top.

12. A method for detecting rotary movement, axial displacement and touchpad gestures, the method comprising the steps of:

performing the rotary movement by a user rotating a knob wherein rotation of the knob rotates an outer shaft fixedly connected to the knob and further wherein shutters extending outward from the outer shaft are rotated by rotation of the knob;

emitting light from at least one encoder PC board;

measuring an intensity of the light wherein an encoder PC board generates a signal indicative of the rotary movement of the knob;

performing axial displacement of the knob by pushing the knob downward wherein the user pushing the knob downward moves an actuator shaft fixedly connected to the knob downward;

generating a signal indicative of the axial displacement of the knob wherein a base PC board generates the signal indicative of the axial displacement of the knob in response to downward movement of the actuator shaft moving a portion of the dome into contact with the base PC board; and applying the touchpad gestures to a touchpad located within the knob wherein the touchpad is responsive to the touchpad gestures wherein a touchpad PC board generates a signal indicative of the touchpad gestures.

13. The method of claim 12 further comprising the step of:

transmitting the signal indicative of the rotary movement of the knob and the signal indicative of the axial displacement of the knob to the base PC board.

14. The method of claim 12 further comprising the step of:

preventing rotation of the actuator shaft when the knob rotates wherein ridges from the actuator shaft insert into grooves in a base shaft in which the actuator shaft is located and further wherein insertion of the ridges into the grooves prevents rotation of the actuator shaft when the knob rotates.

15. The method of claim 12 further comprising the step of:

preventing rotation of the touchpad PC board when the knob rotates wherein connection of the touchpad PC board to a shaft clip fixedly connected to the actuator shaft prevents rotation of the touchpad PC board when the knob rotates.

16. The method of claim 12 further comprising the step of:

preventing rotation of the touchpad when the knob rotates wherein connection of the touchpad to a rotary girder within the knob prevents rotation of the touchpad when the knob rotates.

17. The method of claim 12 further comprising the step of:

moving the knob upward after the knob is pushed downward wherein the knob is moved upward by the portion of the dome regaining a position not in contact with the base PC board to push the actuator shaft upward.

18. The method of claim 12 further comprising the step of:

inserting protrusions into teeth which extend from the outer shaft wherein insertion of the protrusions into the teeth as the knob rotates provides resistance against the rotary movement of the knob.

19. The method of claim 12 wherein the outer shaft is located at least partially within an encoder housing and further wherein the light pipe, the shutters and the encoder PC board are located within the encoder housing.

20. The method of claim 19 wherein the dome and the base PC board are located within a base housing and further wherein a base shaft extends from the base housing through the outer shaft to connect to a shaft clip located at least partially within the knob.

21. A device comprising:

a knob package having a knob, a touchpad and a touchpad PC board wherein the touchpad PC board is located within the knob and further wherein the knob has an opening in which the touchpad PC board is located wherein the touchpad PC board generates a signal indicative of user gestures applied to the touchpad and further wherein rotation of the knob package does not rotate the touchpad and does not rotate the touchpad PC board;

an encoder package having an encoder housing, an outer shaft, and an encoder PC board wherein the encoder PC board is located within the encoder housing and further wherein the outer shaft is located at least partially within the encoder housing wherein the outer shaft is rotatably connected to the encoder housing and fixedly connected to the knob and further wherein the encoder PC board is fixedly connected to the encoder housing wherein the encoder PC board generates a signal indicative of a rotary position of the knob; and an electronics package having a housing base, a base shaft, a base PC board and an actuator shaft wherein the base shaft extends from the housing base and further wherein the base PC board is located within the housing base under the base shaft wherein the actuator shaft is located at least partially within the base shaft wherein the base PC board generates a signal indicative of an axial position of the knob wherein the base shaft extends through the outer shaft into the interior of the knob package to connect the knob package, the electronics package and the encoder package to each other; and springs having protrusions wherein the springs are fixedly connected to the encoder housing and further wherein the protrusions insert into teeth extending from the outer shaft.

* * * * *